United States Patent [19]

Smith

[11] Patent Number: 4,557,112

[45] Date of Patent: Dec. 10, 1985

[54] METHOD AND APPARATUS FOR CONVERTING THERMAL ENERGY

[75] Inventor: Ian K. Smith, London, England

[73] Assignee: Solmecs Corporation, Curacao, Netherlands Antilles

[21] Appl. No.: 450,613

[22] Filed: Dec. 17, 1982

[30] Foreign Application Priority Data

Dec. 18, 1981 [IL] Israel ..... 64582
Oct. 4, 1982 [GB] United Kingdom ..... 8228295

[51] Int. Cl.[4] ..... F01K 25/08
[52] U.S. Cl. ..... 60/651; 60/671
[58] Field of Search ..... 60/642, 643, 645, 651, 60/671

[56] References Cited

U.S. PATENT DOCUMENTS 3,636,706 1/1972 Minto ..... 60/651
3,750,393 8/1973 Minto et al. ..... 60/671 X
4,109,468 8/1978 Heath ..... 60/671 X

*Primary Examiner*—Stephen F. Husar
*Attorney, Agent, or Firm*—Sughrue, Mion, Zinn, Macpeak & Seas

[57] ABSTRACT

A method of converting thermal energy into another energy form, comprising the steps of providing a liquid working fluid with said thermal energy, substantially adiabatically compressing the working fluid, substantially adiabatically expanding the hot compressed working fluid by flashing to yield said other energy form in an expansion machine capable of operating with wet working fluid and of progressively drying said fluid during expansion, and condensing the exhaust working fluid from the expansion machine. Apparatus for converting thermal energy into another energy form is also provided.

23 Claims, 19 Drawing Figures

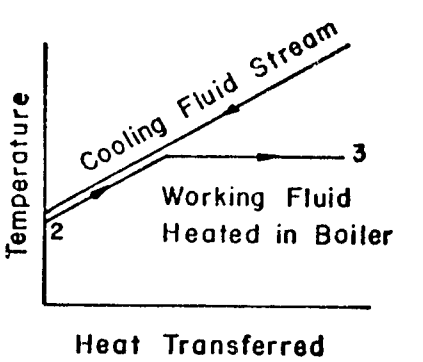
FIG. 7
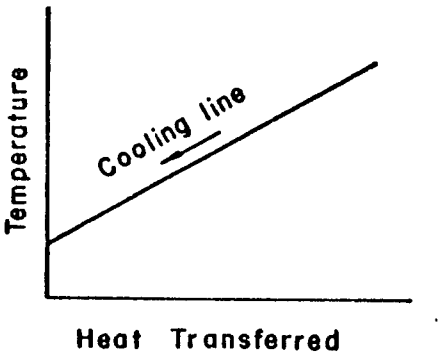
FIG. 9
FIG. 8
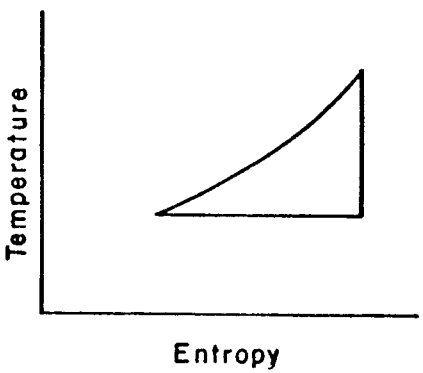
FIG. 10

METHOD AND APPARATUS FOR CONVERTING THERMAL ENERGY

The present invention refers to a method of and apparatus for converting thermal energy into other forms of energy.

With the current and projected energy situation, efforts are increasingly being made to utilize sources of energy such as low-temperature industrial waste gases and liquids, geothermally heated water and the like, all of which sources were regarded as marginal and economically unfeasible for power generation as recently as ten years ago, when fossil fuel was still relatively inexpensive. Today, processes are being developed and apparatus devised which can definitely be regarded as profitable propositions.

Most of these processes are thermo-dynamically based on the well-known Rankine cycle and comprise a shaft power-producing heat engine utilizing the expansive properties of gases or vapors. In all such engines an important feature of the work-producing process is that the vapor or gas should remain in the same phase throughout expansion and that the formation of liquid during expansion be avoided, because most mechanical expanders such as turbines and reciprocators do not operate well when liquid is present. Steam engines, which operate on a variety of modifications of the basic Rankine cycle to produce power, often incur a certain amount of moisture during the expansion process, either because the steam ls initially wet or because, due to the thermodynamic properties of steam, the expanding vapor becomes wetter during the expansion process. In such cases, the engine is always made to minimize the moisture formation in the expander, either by superheating the steam, flashing it to a lower pressure before it enters the expander, or by separating off excess moisture at intermediate stages of the expansion process. In recent years an important method of reducing the moisture content of expanding vapors in Rankine-cycle engines has been to use heavy molecular-weight organic fluids in place of steam. Such engines, as manufactured by Ormat in Israel, Thermoelectron, Sundstrand, GE, Aerojet and other companies in the U.S.A., IHI and Mitsui in Japan, Societe Bertin in France, Jornier in Germany, and other companies in Italy, Sweden and the Soviet Union, all have the important feature in their cycle of operation that there is virtually no moisture formed in the expander. This permits higher tubine efficiencies than is possible with steam and constitutes a major reason for their good performarce in low-temperature power systems used for the recovery of waste heat and geothermal energy.

However, Rankine-cycle-based processes still suffer from a number of drawbacks which impair their efficiency; thermal energy is consumed not only to raise the liquid temperature up to the boiling point, but also beyond that, along the entire evaporation portion of the cycle. Indeed, when organic working fluids are used, almost invariably they leave tne expander in the superheated state and have to be desuperheated in an enlarged condenser. Although part of the abstracted desuperheat can be recycled to preheat the compressed liquid, this requires an additional heat exchanger known as regenerator and while the above disadvantages can be circumvented to some degree by supercritical heating, such a step has to be paid for in greatly increased feed-pump work, which again reduces cycle efficiency.

Also, the non-uniform rise of temperature of the working fluid during the heating process in the boiler makes it impossible to obtain a high cycle efficiency and to recover a high percentage of available heat simultaneously when the heat source is a single-phase fluid such as a hot gas or hot liquid stream.

Clearly, it is desirable to overcome the drawbacks and deficiencies of the Rankine-cycle prior art and to provide a method which requires heating of the working liquid only up to its boiling point, evaporation being effected by flashing during the expansion portion of the cycle. This dispenses with the need for a regenerator and permits a higher overall conversion of available heat to power from single-phase fluid streams. For low-temperature heat sources, which comprise the majority of industrial waste heat, solar ponds, geothermally-heated water and the like, this is substantially more cost-effective than the best Rankine-cycle based apparatus. Briefly, a solar pond is a shallow body of water with an upper layer of non-saline water and a lower layer of brine. The latter is heated to temperatures as high as 95° by the sun's radiation and heat can be abstracted from this brine.

According to the present invention there is provided a method of converting thermal energy into another energy form, comprising the steps of providing a liquid working fluid with said thermal energy, substantially adiabatically compressing the working fluid, substantially adiabatically expanding the hot compressed working fluid by flashing to yield said other energy form in an expansion machine capable of operating with wet working fluid and of progressively drying said fluid during expansion, and condensing the exhaust working fluid from the expansion machine.

Further according to the present invention there is provided apparatus for converting thermal energy into another energy form comprising means for supplying a liquid working fluid with said thermal energy, pump means for substantially adiabatically compressing the working fluid, expander means for substantially adiabatically expanding the hot working fluid by flashing to yield said other energy form, said expander means being capable of operating with wet working fluid and of progressively drying said working fluid during expansion and condensing the exhaust working fluid from the expansion machine.

The invention will now be described, by way of example, in connection with reference to the accompanying diagrammatic drawings, in which:

FIG. 7 illustrates the cooling of a stream of hot liquid or gas going to waste;

FIG. 8 shows how this cooling line is matched to the heating portion of the cycle in FIGS. 1, 2 and 4;

FIG. 9 is similar to FIG. 8, but indicates a more desirable matching than that of FIG. 8.

FIG. 10 shows the T-s diagram of the novel, trilateral, "wet-vapor" cycle according to the invention which results from the matching indicated in FIG. 9;

The method according to the present invention, which is suitable for constant-phase sources of thermal energy, i.e., sources that, upon transferring their thermal energy to the working fluid, do not change phase, is best understood by a detailed comparison with the well-known Rankine cycle from which it differs in essential points, although the mechanical components with which these two different cycles are realized, are substantially identical.

Figure 2:
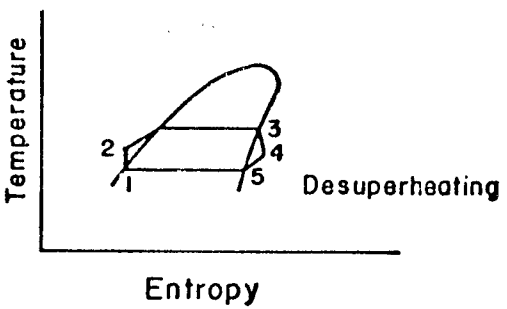
FIG. 2 is a T-s diagram of a Rankine cycle using an organic liquid.
Figure 1:
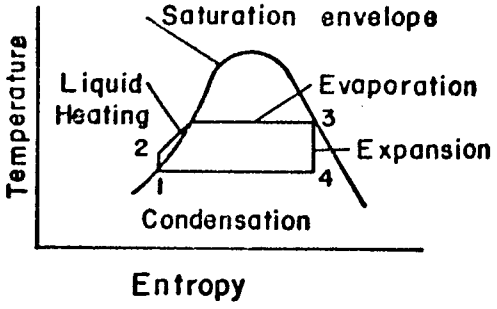
FIG. 1 is a T-s (Temperature-Entropy) diagram of a Rankine cycle using steam.

The basic Rankine cycle is illustrated in T-s diagrams in FIG. 1 for steam and in FIG. 2 for an organic working fluid, such as is used, e.g., in the Ormat system.

The sequence of operations in FIG. 1 is liquid compression (1→2), heating and evaporation (2→3), expansion (3→4) and condensation (4→1). It should be noted that in this case the steam leaves the expander in the wet state. As to FIG. 2, the properties of organic fluids are such that in most cases the fluid leaves the expander in the superheated state at point 4, so that the vapor has to be desuperheated (4→5) as shown in FIG. 2. Desuperheating can be achieved within an enlarged condenser.

Figure 3:
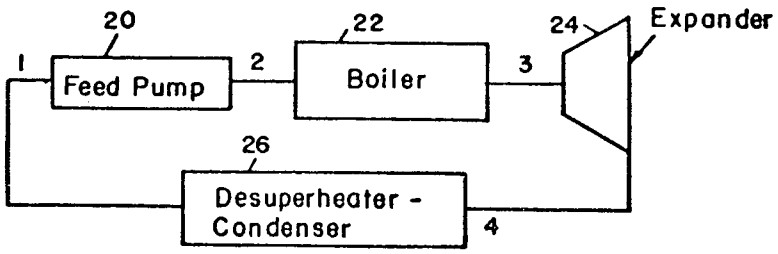
FIG. 3 is a block diagram of the mechanical components used to produce the sequence indicated in FIG. 2.

The mechanical components which produce this sequence of operations are shown in FIG. 3 and include a feed pump 20, a boiler 22, an expander 24 (turbine, reciprocator or the like), and a desuperheater-condenser 26.

Figure 4:
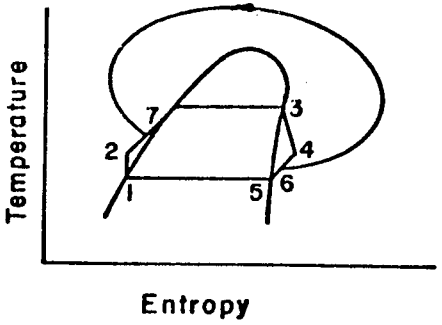
FIG. 4 is a T-s diagram similar to that of FIG. 2, but with the rejected desuperheat used to preheat the compressed liquid.
Figure 5:
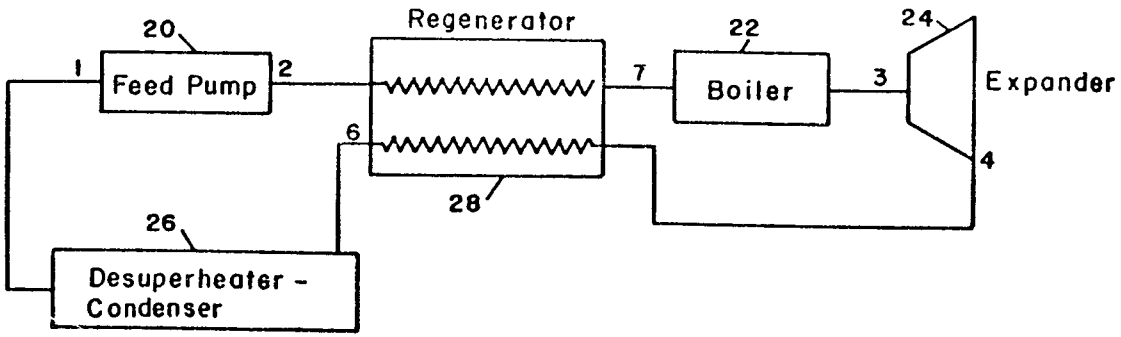
FIG. 5 is a block diagram showing the use of a regenerator.

FIG. 4 shows as how the rejected desuperheat (4→5 in FIG. 2) can be utilized to improve cycle efficiency by using at least part of it to preheat the compressed liquid (2→7), thereby reducing the amount of external heat required. Physically, this is achieved by the inclusion in the circuit, of an additional heat exchanger 28, known as a regenerator, as shown in FIG. 5.

In T-s diagrams such as those used throughout this specification, the area delimited by the lines joining the sequence of points in a cycle represents the work done.

Figure 6:
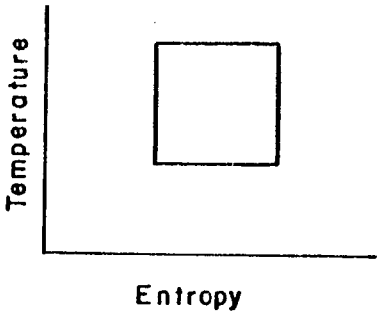
FIG. 6 is a T-s diagram of the ideal Carnot cycle.

Now, it is a well-known consequence of the laws of thermodynamics that, when heat is obtained from a constant-temperature or infinite heat source, the ideal heat-engine cycle is the Carnot cycle shown in FIG. 6.

Examining FIGS. 1, 2 and 4, it is seen that the Rankine cycle comes close to the ideal Carnot cycle largely because of the large amount of heat supplied at constant temperature during the evaporation process indicated in FIG. 1. This process takes place in the boiler and, in nearly all cases, the amount of heat supplied, is much larger than that necessary to raise the temperature of the working fluid to its boiling point. It follows that evaporation of the fluid is a key feature of the sequence of processes involved in an Ormat-type system and, indeed, any Rankine cycle. However, when heat is not supplied from an infinite or constant-temperature heat source, the Carnot cycle is not necessarily the ideal model. Consider a flow of hot liquid or gas going to waste. If this flow is cooled, the heat transferred from it is dependent on its temperature drop as shown in the cooling curve on temperature vs. heat-transferred coordinates in FIG. 7.

Matching of the cooling of a constant-phase fluid flow to the boiler heating process 2→3 in FIGS. 1 and 2, and 7→3 in FIG. 4, is shown in FIG. 8. In this case, it can be seen that the large amount of heat required to evaporate the working fluid in the Rankine-cycle boiler limits the maximum temperature which the working fluid can attain to a value far less than the maximum temperature of the fluid flow being cooled.

A much more desirable conversion of heat to mechanical power could be attained if the working fluid heated in the boiler followed a temperature versus heat-transferred path which exactly matches that of the cooling fluid flow which heats it. The ideal case for this is shown in FIG. 9, which would result in an ideal heat-engine cycle shown on T-s coordinates in FIG. 10.

Figure 11:
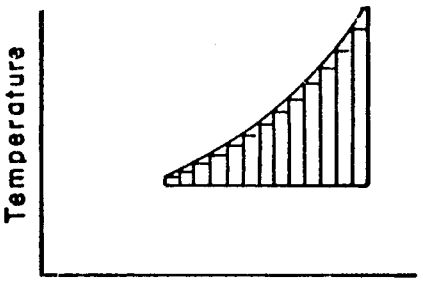
FIG. 11 shows as how this cycle can be conceived as a series of infinitesimal Carnot cycles.

At first sight, this appears to be contrary to the concept of a Carnot cycle as the ideal. However, it must be appreciated that the Carnot cycle is only ideal for a constant-temperature or infinite heat source, whereas here the heating-source temperature changes throughout the heat-transfer process. Another way of visualizing the cycle shown in FIG. 10 is to consider it as a series of infinitesimal Carnot cycles, each receiving heat at a slightly different temperature, as shown in FIG. 11.

Figure 12:
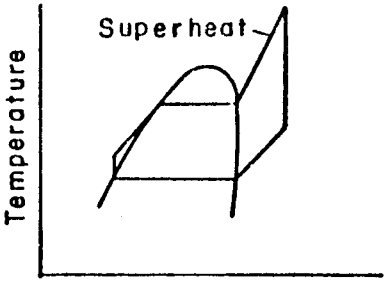
FIGS. 12 and 13 illustrate previous attempts to improve the Rankine cycle for recovering power from constant phase heat streams.
Figure 13:
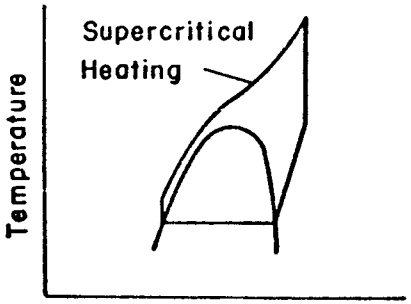

For such a cycle, the large evaporative heat required in an Ormat-type cycle is no advantage. Improvements have, therefore, been proposed to the latter, such as superheating the vapor after evaporation is complete, to obtain the cycle shown in FIG. 12, or to raise the feed-pump exit pressure to the super-critical level, to obtain the cycle shown in FIG. 13, as both these effects bring the Rankine cycle shape nearer the ideal. However, both these cycles usually require a large amount of desuperheat, which means a large regenerator if efficiences are to be maintained, and this means a more expensive system. Both these cycles normally expand the working fluid as dry vapor, though some have been suggested where the vapor may become slightly wet during the expansion process. It is not so well known that the supercritical cycle usually requires a very large amount of feed-pump work, especially if there is little desuperheat in the vapor leaving the expander, and this reduces the cycle efficiency.

Figure 14:
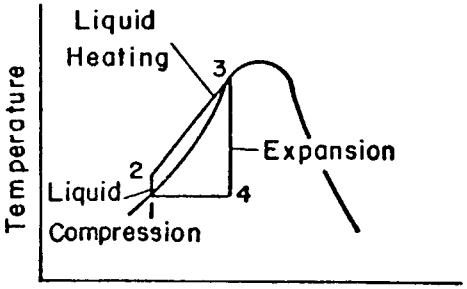
FIGS. 14 and 15 are T-s diagrams including the saturation envelope, explaining the "wet-vapor" cycle in greater detail.
Figure 15:
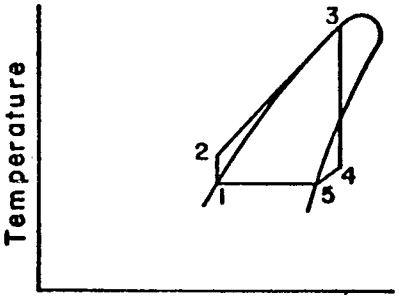
Figure 16:
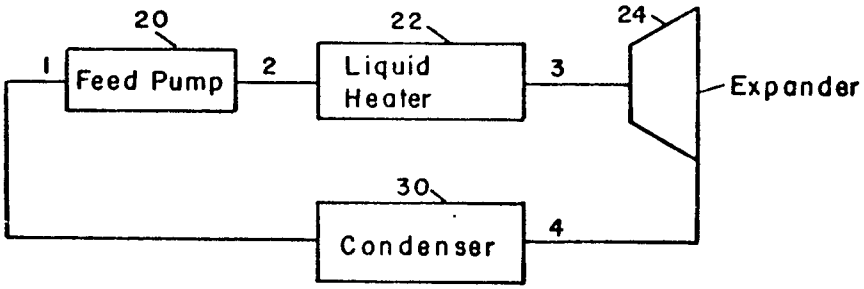
FIG. 16 is a block diagram of the mechanical components used to produce a T-s diagram as in FIG. 14.

The new cycle according to the present invention is that shown on temperature-entropy coordinates in FIGS. 14 and 15, and is seen to consist of liquid compression (1→2) as in the Rankine cycle, heating in the liquid phase only (2→3), expansion (3→4) by phase change from liquid to vapor, as already described, and condensation back to 1. It can be seen from FIG. 15 that, for some organic fluids, expansion leads to completely dry vapor at the expander exit. The sequence of components needed for this cycle is shown in FIG. 16.

Figure 17:
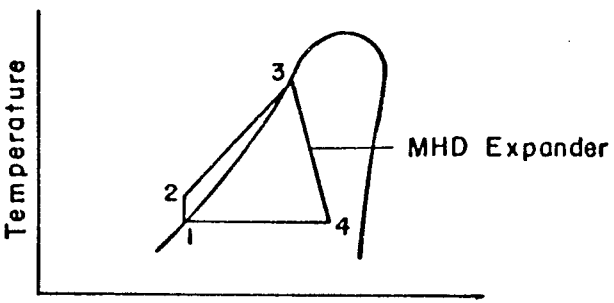
FIG. 17 is a T-s diagram of the novel cycle when used in conjunction with a compound liquid-metal/-volatile-liquid working fluid as in MHD applications.

While these components are basically identical with those used in the basic Rankine cycle, (except for the smaller condenser 30), the wet-vapor differs radically from the Rankine cycle in that, unlike in the latter, the liquid heater should operate with minimal or preferably no evaporation, and the function of the expander differs from that in the Rankine system as already described. If compared with the supercritical Rankine cycle shown in FIG. 13 where heating is equally carried out in one phase only, the cycle according to the invention still differs in that it is only in this novel cycle that the fluid is heated at subcritical pressures, which is an altogether different process, and the expander differs from the Rankine-cycle expander as already described. Should this cycle be used with a compound liquid-metal/-volatile-liquid working fluid, as in MHD applications, then, on temperature-entropy coordinates, the expansion line will slope more to the right as shown on FIG. 17 due to the large heat capacity of the liquid metal. The volatile fluid will thus be much drier at the expander exit.

The cycle according to the invention confers a number of advantages over the Rankine cycle even in such an extremely modified form of the latter as in the supercritical system. These advantages are:

(1) It requires little or no desuperheat and hence no regenerator;

(2) It requires less feed-pump work than a super-critical Rankine cycle;

(3) It permits higher cycle efficiencies in the case of constant-phase heat flows, and (4) It enables more heat to be transferred to the working fluid from constant-phase flows where there are no limits to the temperature to which the constant-phase flow can be cooled, than is possible with Rankine cycles.

Figure 18:
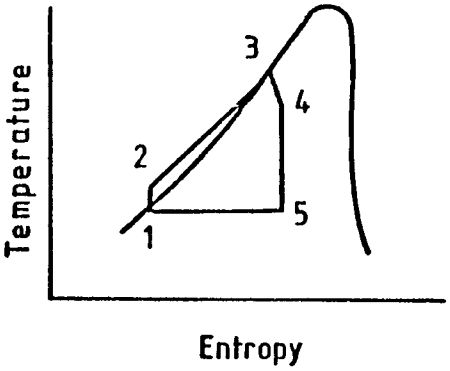
FIG. 18 is a T-s diagram of a more practical form of the wet-vapor cycle.
Figure 19:
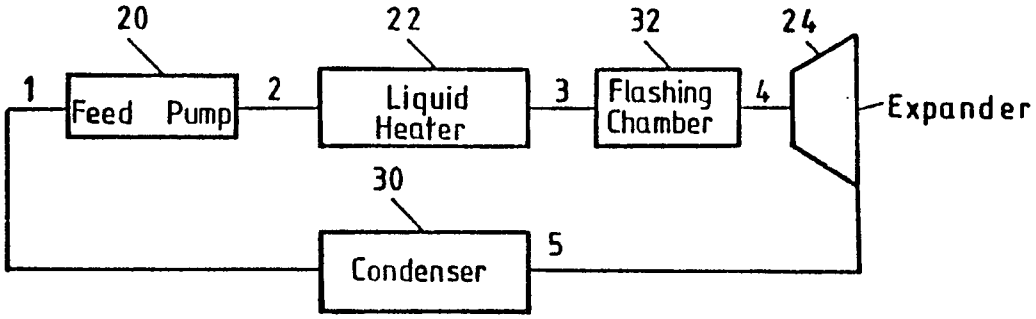
FIG. 19 is a block diagram of the mechanical components used to produce a T-s diagram as in FIG. 18.

The efficiency of the cycle according to the invention can be greatly enhanced by carrying out the initial stages of the expansion in a flashing chamber prior to the production of work in the expander as indicated in process 3-4 on the T-s diagram in FIG. 18 and in item 32 in the block diagram of components shown in FIG. 19. By this means the first part of the expansion is not required to take place at a rate dictated by the required speed of rotation of the expander and sufficient time can be allowed for this process in the flashing chamber in order to achieve a well mixed liquid/vapor combination at equilibrium conditions before any further expansion begins. In addition, the volume expansion ratio of the expander is thereby substantially reduced, making the task of designing it much easier.

Superfically it would appear that such a modification of the basic wet vapor cycle may lead to such a loss of available energy as to wipe out its theoretical advantage over the Rankine cycle. Closer examination of the expansion process shows, however, that the penalty in lost power imposed by such a modification is quite small being of the order of only a few percent although the exact amount depends on the working fluid and the temperature range through which it is expanded. The reason for this is because the initial liquid volume is small relative to the final volume attained by the vapor. Since flow work is equal to the integrated product of pressure drop times volume, an expansion ratio of 3 or more in the initial stages is responsible for only a fraction of the work accounted for by a similar expansion ratio in the final stage of expansion. This has been verified by exact calculation.

Calculations using a computer program have been completed on a study of power recovery from Geothermal hot water at 100° C. These were compared with a Rankine cycle system. Assumptions for both were identical except that the Rankine turbine efficiency was assumed to be 85% and that of a suitable screw expander 80%. No allowance was made for circulating the geothermally heated water but this would be almost the same for both with the power loss for the Rankine Cycle possibly slightly larger than for the wet vapour system. Hot water flow rate=75 kg/s. In all cases refrigerant R114 was chosen as the working fluid and all analyses were optimised:

Power from Rankine system=717 kWe

| Wet Vapour System | | | | |
|---|---|---|---|---|
| Flashing Volumetric Ratio | 1.0 | 2.0 | 3.0 | 9.57 |
| Expander Volumetric Ratio | 32.8 | 16.5 | 11.0 | 3.5 |
| Power Output kWe | 1138 | 1105 | 1059 | 700 |
| Percentage Improvement over Rankine System | 59% | 54% | 48% | −2.4% |
| Percentage Power Loss due to flashing | 0.0 | 2.9 | 6.9 | 38.0 |

In these cases the expander volumetric ratio is so low that doubling the fluid volume in flashing makes the entire expansion feasible in a single stage screw expander for a loss of less than 3% of the power. By trebling the volume in flashing the expansion could be achieved even in a single stage vane expander if one could be built for this output.

For higher overall volumetric ratios the power loss penalty would be even less. It will be noted that even the figures for the last column where the expander volumetric ratio is extremely modest, the deterioration in relation to the Rankine system is very slight.

To assess the possible advantages of such a cycle over Rankine alternatives, a highly detailed study of recoverable power from hot-rock, geothermally-heated, water was carried out, assuming a water flow rate of 75 kg/sec. Many working fluids were considered and for each of these, all systems were fully optimized, using a computer program developed over a period of 10 years, which program includes a detailed account of all internal losses and inefficiencies. The results of this study are summarized in the following table:

| | Power Output Attainable, kWe | | Estimated Cost per Unit Output, £/kWe | |
|---|---|---|---|---|
| Geothermally Heated Water Inlet Temp. °C. | Best Rankine Cycle | Wet Vapor Cycle | Best Rankine Cycle | Wet Vapor Cycle |
| 150 | 2600 | 3500 | 380 | 350 |
| 170 | 4070 | 4780 | 330 | 290 |
| 190 | 5470 | 6160 | 290 | 250 |
| 210 | 6920 | 7420 | 280 | 230 |

It is clearly seen that the new "wet-vapour" cycle offers prospects of significantly greater power recovery at a lower cost per unit cutput than any Rankine cycle system.

Further studies were carried out on very low-temperature systems as used for power recovery from solar ponds and collectors and here outputs nearly three times as great as those from Rankine Cycle systems were shown to be possible.

A further advantage of the "wet-vapour" cycle according to the invention will be explained in the following:

Many industrial processes, particularly in chemical plants, terminate with large quantities of hot liquids which have to be cooled. In such plants, large heat-exchangers are required to remove the heat and these can, of course, form boilers for power plants in accordance with the invention as hereinbefore described. An alternative way of using this process heat is to dispense with the boiler and use the hot liquid itself as the working fluid so that it enters the expander either directly or through a flashing chamber and produces work while expanding and cooling. The final heat extraction still requires a pump to recompress the liquid and a condenser after the expansion stage, but such a process "wet-vapour" expander system will be cheaper than an installed heat engine, in that it requires no boiler or liquid heater and it will be more efficient in that no temperature drop is required to transfer the heat from one fluid to the other in the boiler or heater.

This principle may also be used with a wet-vapour expander in recovering power from hot-rock geothermal or other thermal sources, when the circulating fluid need not be limited to water.

As already mentioned, one of the fundamental differences between the "wet-vapour" cycle of the preent invention and the Rankine cycle resides in the fact that, with the former, the change of phase during the expansion process is a most essential feature, whereas in the latter it is to be avoided as far as possible. Moreover, when moisture does form in a Rankine-cycle system, the vapour becomes progressively wetter during the expansion process, while in the "wet-vapour" cycle according to the invention, the vapour becomes drier as expansion proceeds.

As a consequence of the above, conventional turbines and reciprocators are not suitable for the expansion phase of the "wet-vapour" cycle according to the invention, since liquid droplets erode turbine blades and reduce the aerodynamic efficiency of the turbine, while washing the lubricating oil off the cylinder walls of reciprocating expanders, thus promoting wear and seizure of the mechanism. Alternative machines exist which can be used for this purpose; the following are examples:

(1) Positive-displacement machines such as rotary-vane and screw expanders. The presence of liquid in these should promote lubrication and reduce leakage. Small machines of the vane type with very high efficiencies are available;

(2) Two phase turbines; and (3) MHD (magnetohydrodynamic) ducts through which the working fluid flows. In this case, the fluid comprises a mixture of a volatile liquid which changes its phase and a non-volatile liquid such as a liquid metal or other conducting fluid, which is propelled through a rectangular section duct by the expanding volatile liquid. If two opposite walls of the duct generate a magnetic field between them and the other pair of opposite walls contain electrical conductors, direct generation of electricity by this means is possible.

A variety of working fluids have been examined for use in the proposed "wet-vapour" cycle and "wet-vapour" process expansion systems, including Refrigerants 11, 12, 21, 30, 113, 114, 115, toluene, thiophene, n-pentane, pyridine hexafluorobenzene, FC 75, monochlorobenzene and water. The main disadvantage of water is the very high volume ratios required in the expander, but R 11, R 12 and most of the other refrigerants as well as n-pentane give much more desirable volume ratios which can be attained in one, two, three or four stages of expansion, dependent un the temperature limits of operation.

In order to increase system efficiency, the system may advantageously include features to accelerate the flashing process both in the expander and in the flashing chamber, if fitted. These features, per se known, include turbulence promoters to impart swirl to the fluid before it enters the expander; seeding agent to promote nucleation points for vapour bubbles to form in the fluid; wetting agents to reduce the surface tension of the working fluid and thereby accelerate the rate of bubble growth in the initial stages of flashing, and combinations of all or selected ones of these features.

In addition, mechanical expander efficiencies can be improved by the addition of a suitable lubricant to the working fluid to reduce friction between the contacting surfaces of the moving working parts.

It will be appreciated that although the working fluid is preferably organic, suitable inorganic fluids can also be used. The thermal source, although generally liquid from the point of view of keeping the size of heat exchangers within reasonable limits, can also be a vapour or a gas.

It will be evident to those skilled in the art that the invention is not limited to the details of the foregoing illustrative embodiments and that the present invention may be embodied in other specific forms without departing from the essential attributes thereof, and it is, therefore, desired that the present embodiments be considered in all respects as illustrative and not restrictive, reference being made to the appended claims, rather than to the foregoing description, and all changes which come with the meaning and range of equivalency of the claims are, therefore, intended to be embraced therein.

I claim:

1. A method of converting thermal energy into another energy form, comprising the steps of substantially adiabatically pressurizing a liquid working fluid, supplying thermal energy to said working fluid, substantially adiabatically expanding the hot working fluid by flashing to yield said other energy form in an expansion machine capable of operating effectively with wet working fluid and of progressively drying said fluid during expansion, and condensing the exhaust working fluid received from the expansion machine.

2. A method according to claim 1 wherein flashing is initiated prior to admission to the expansion machine.

3. A method according to claim 1, wherein the condensate is recirculated for recompression.

4. A method according to claim 3 wherein the working fluid is adiabatically pressurized from a cold saturated state, and heated by heat transfer from a source of thermal energy.

5. A method according to claim 1, wherein the expansion machine is a rotary vane machine.

6. A method according to claim 1, wherein the expansion machine is a screw expander.

7. A method according to claim 1, wherein the working fluid is an organic or suitable inorganic fluid.

8. A method according to claim 7, wherein said organic working fluid is selected from the group including refrigerants 11, 12, 21, 30, 113, 114, 115, toluene, thiophene, n-pentane, pyridene, hexafluorobenzene, FC 75, monochlorobenzene and water.

9. A method according to claim 3, wherein said working fluid is a mixture of a liquid, electrically-conducting substance and a volatile liquid and said working fluid is adiabatically expanded in a magneto-hydrodynamic duct.

10. A method according to claim 1, further comprising the step of accelerating said flashing process by inducing turbulence in said working fluid upstream of the inlet of said expansion machine.

11. A method according to claim 1, further comprising adding seeding agents to promote nucleation points for vapour bubbles to form in the fluid upstream of the inlet of the expansion machine.

12. A method according to claim 1, further comprising adding wetting agents to reduce the surface tension of the working fluid and thereby accelerate the rate of flashing.

13. A method according to claim 1, comprising adding lubricants to the working fluid to improve the efficiency of the expansion machine.

14. A method of converting thermal energy into another energy form, comprising substantially adiabatically pressurizing an organic working fluid in a cold, saturated state, heating the working fluid by heat transfer from the source of said thermal energy, initially flashing the working fluid and continuing flashing of the wet working fluid in an expander wherein the wet fraction is decreased and whereby shaft power is produced, condensing the exhaust from said expander and returning the condensate to the pressurizing stage.

15. A method of converting thermal energy into another form of energy, comprising the steps of providing a liquid working fluid to be exposed to the source of said thermal energy, substantially adiabatically pressurizing said working fluid in the cold, saturated, state thereof, heating the working fluid by heat transfer from said source at approximately constant pressure substantially to the boiling point of said working fluid, substantially adiabatically expanding the heated working fluid down to the approximate pressure thereof immediately prior to said pressurizing, said working fluid being thereby flashed from the liquid phase to the vapour phase, yielding energy, condensing said working fluid from the vapour phase to the liquid phase thereof and recirculating the condensed working fluid to the commencement of the pressurizing stage.

16. Apparatus for converting thermal energy into another energy form, comprising pump means for substantially adiabatically pressurizing a liquid working fluid, means for supplying said working fluid with said thermal energy, means connecting the pump outlet to said means for supplying thermal energy, expander means for substantially adiabatically expanding the hot working fluid by flashing to yield said other energy form, means connecting the outlet of said energy supply means to said expander means, said expander means being capable of operating with wet working fluid and of progressively drying said working fluid during expansion, and condenser means for condensing the exhaust working fluid from said expander means.

17. Apparatus according to claim 16, comprising means for initiating said flashing upstream of the expander means.

18. Apparatus according to claim 16, comprising means for recirculating the condensate to the inlet of the pump means.

19. Apparatus according to claim 18, comprising heat-exchange means for transferring said thermal energy from a source to the working fluid at a cold, saturated state.

20. Apparatus according to claim 16, wherein the expander means is a rotary vane machine.

21. Apparatus according to claim 16, wherein the expander means is a screw expander.

22. Apparatus according to claim 16, wherein the expander is a magneto-hydrodynamic duct.

23. Apparatus for converting thermal energy into electrical power comprising pump means for adiabatically pressurizing a cold, saturated, organic working fluid and delivering the compressed working fluid to a heat-exchanger, the hot pass of which receives a flow of geothermally or otherwise heated liquid, vapour or gas, a flashing chamber connected to said heat exchanger, wherein the heated working fluid is flashed to a degree such that a minor proportion of the overall expansion ratio is expanded therein, means for connecting said flashing chamber to an expander machine in which the flashing is substantially completed by adiabatic expansion of the working fluid, said expander machine being operable with the working fluid in an at least initially wet state, a condenser for condensing the exhaust from the expander machine and means for returning the condensate to the inlet of the pump means.

* * * * *